US006752885B1

(12) United States Patent
Jerichow

(10) Patent No.: US 6,752,885 B1
(45) Date of Patent: Jun. 22, 2004

(54) METHOD FOR THE TREATMENT OF STRUCTURE CASTINGS FROM AN ALUMINUM ALLOY TO BE USED THEREFOR

(75) Inventor: Ulrich Jerichow, Nuremberg (DE)

(73) Assignee: Honsel Guss GmbH (DE)

( * ) Notice: Subject to any disclaimer, the term of this patent is extended or adjusted under 35 U.S.C. 154(b) by 127 days.

(21) Appl. No.: 10/088,779

(22) PCT Filed: Sep. 9, 2000

(86) PCT No.: PCT/EP00/08822

§ 371 (c)(1),
(2), (4) Date: Mar. 20, 2002

(87) PCT Pub. No.: WO01/23633

PCT Pub. Date: May 4, 2001

(30) Foreign Application Priority Data

Sep. 24, 1999 (DE) ..... 199 45 754
Jan. 19, 2000 (DE) ..... 100 02 021

(51) Int. Cl.[7] ..... C22F 1/04
(52) U.S. Cl. ..... 148/698; 148/549
(58) Field of Search ..... 148/698, 690, 148/693, 694, 697, 549

(56) References Cited

U.S. PATENT DOCUMENTS

| | | | | |
|---|---|---|---|---|
| 4,695,329 | A | 9/1987 | Hayashi et al. | |
| 4,786,340 | A | 11/1988 | Ogawa et al. | 148/439 |
| 6,364,970 | B1 | 4/2002 | Hielscher et al. | |

FOREIGN PATENT DOCUMENTS

| | | | |
|---|---|---|---|
| CH | 689143 | A5 | 10/1998 |
| DE | 1027409 | | 4/1958 |
| DE | 3605519 | C2 | 9/1986 |
| EP | 687742 | A1 | 12/1995 |
| EP | 0796926 | | 9/1997 |
| WO | 9308314 | | 4/1993 |

OTHER PUBLICATIONS

"Heat Treating of Aluminum Alloys", 1991, *ASM Handbook*, Ohio, U.S., XP–002163162, pp. 841–872.

W. Hufnagel, "Aluminum–Taschenbuch", 1983, *Aluminum Verlag*, Düsseldorf, Germany, XP–002163163, pp. 1024–1030.

W. Schneider, et al., "Wärmebehandlung von Aluminium–Guβlegierungen für das Vakuum–Druckgieβen", Teil 4: Ergebnisse von Auslagerungsversuchen, *Gieserrei*, Giesserei Verlag, Düsseldorf, Germany, vol. 83, No. 19, Sep. 30, 1996, pp. 23–27, XP–000627093.

W. Schneider, et al., "Wärmbehandlung von Aluminium–Guβlegierungen für das Vakuum–Druckgieβen", Teil 5: Ergebnisse von Auslagerungsversuchen (Fortsetzung), *Gieserrei*, Giesserei Verlag, Düsseldorf, Germany, vol. 84, No. 4, Feb. 24, 1997, pp. 17–22, XP–000688088.

German Office Action.

*Primary Examiner*—George Wyszomierski
*Assistant Examiner*—Janelle Combs-Morillo
(74) *Attorney, Agent, or Firm*—Ostrolenk, Faber, Gerb & Soffen, LLP

(57) ABSTRACT

A process for the heat treatment of structure castings made from an aluminum alloy, comprising the steps of: placing the structure casting onto a contour-embracing product receiving device, heating to 490° C. over the course of approximately 30 minutes, holding the temperature of 490° C. for a time of between 90 and 120 minutes, quenching in air from 490° C. to approximately 100° over the course of approximately 4 minutes, if appropriate followed by quenching in water, heating to 250° C. over the course of approximately 15 minutes, holding the temperature of 250° C. for a time of between 30 and 120 minutes, quenching in air to 40° C., if appropriate followed by quenching in water; a light metal alloy for use with this process, having the following composition: Si: 2–11.5%, Fe: 0.15–0.4%, Mg: 0.3–5.5%, Cu & It: 0.02%, Mn: 0.4–0.8%, Ti: 0.1–0.2%, remainder aluminum and trace elements, the alloys with a high silicon content having a low magnesium content and vice versa.

12 Claims, No Drawings

METHOD FOR THE TREATMENT OF STRUCTURE CASTINGS FROM AN ALUMINUM ALLOY TO BE USED THEREFOR

The invention relates to a process for the heat treatment of structure castings made from an aluminum alloy and to an aluminum alloy to be used for this purpose.

Aluminum structure castings made from an aluminum alloy are used, for example, in the automotive industry and should have good mechanical properties, in particular a high elongation at break, good castability, no tendency to stick in the mold and good mold-release properties, a high design strength and good-weldability. Since the known aluminum casting alloys-do not have the required properties in the cast state, heat treatment processes and aluminum alloys have been developed to enable industrial requirements to be satisfied to an ever more accurate and less expensive extent. Special heat treatment processes designated T64 and T7 have become known for this process. These heat treatment processes are described, for example, in "Das Techniker Handbuch" [The Engineering Handbook] Böge, Vieweg, 13th Edition, pages 551 to 554. These heat treatment processes involve a two-stage procedure as detailed below:

T64 (Thermally Unstable):

1st stage: Heating to 480 to 520° C., holding for 2 to 5 hours, quenching in water at 20° C.;

2nd stage: Heating to 155 to 170° C., holding for 2 to 6 hours, quenching in air.

T7 (Thermally Stable up to 230° C.):

1st stage: Heating to 480 to 520° C., holding for 2 to 5 hours, quenching in water at 20° C.

2nd stage: Heating to 200 to 230° C., holding for 2 to 3 hours, quenching in air.

The structure castings which have been treated using the heat treatment process T64 are not thermally stable at elevated temperatures, but castings which have been treated using heat treatment process T7 are stable at elevated temperatures. A drawback of both heat treatment processes T64 and T7 is that the structure castings produced by means of the die-casting process lose their extremely high dimensional accuracy which is present in the cast state, on account of the high thermal stress states which occur in the structure casting during the quenching in water. The structure castings are dimensionally unstable after the first heat treatment stage and have to be dimensionally accurate by expensive and complicated straightening operations. This problem is particularly acute in structure components, since these structure castings have a high level of complexity and integrity and have to satisfy high demands imposed on the dimensional accuracy.

The invention is therefore based on the problem of providing a heat treatment process which can be used to achieve good mechanical properties and a high dimensional accuracy at low cost and by simple means.

Working on the basis of this problem, the invention proposes a process for the heat treatment of structure castings made from an aluminum alloy, which comprises the steps of:

placing the structure casting onto a contour-embracing product receiving device, heating to 490° C. over the course of approximately 30 minutes, holding the temperature of 490° C. for a time of between 60 and 90 minutes, quenching in air from 490° C. to approximately 100° C. over the course of approximately 4 minutes, if appropriate followed by quenching in water, heating to 250° C. over the course of approximately 15 minutes, holding the temperature of 250° C. for a time of between 30 and 120 minutes, quenching in air to 40° C., if appropriate followed by quenching in water.

Preferably, the temperature of 490° C. can be held for approximately 60 minutes, and the temperature of 250° C. can be held for approximately 30 minutes.

If, according to a second process variant, the temperature of 490° C. is held for approximately 90 minutes, the temperature of 250° C. can be held for approximately 30 minutes or approximately 45 minutes or approximately 75 minutes or approximately 105 minutes, with the result that the mechanical properties can be varied according to the spectrum of requirements.

A suitable aluminum alloy for use with the process according to the invention may have the following composition:

| | |
|---|---|
| Si: | 5–11.5% |
| Fe: | 0.15–0.4% |
| Mg: | 0.3–1.0% |
| Cu: | <0.02% |
| Mn: | 0.4–0.8% |
| Ti: | 0.1–0.2% |

Remainder: aluminum and trace elements.

A suitable Al—Mg alloy may have the following composition:

| | |
|---|---|
| Si: | 1–3% |
| Fe: | 0.15–0.4% |
| Mg: | 3–5.5% |
| Cu: | <0.02% |
| Mn: | 0.4–0.8% |
| Ti: | 0.1–0.2% |
| Zn: | <0.08% |

Remainder: aluminum and trace elements.

A suitable eutectic or almost-eutectic Al—Si alloy may have the following composition:

| | |
|---|---|
| Si: | 7–11.5% |
| Fe: | 0.15%–0.4% |
| Mg: | 0.3–0.4% |
| Cu: | <0.02% |
| Mn: | 0.4–0.6% |
| Ti: | 0.15–0.2% |
| Sr: | up to 300 ppm |

Remainder: aluminum and trace elements.

These alloys are subjected to a melt treatment, such as degassing and/or filtration, before being introduced into the casting process. The vacuum which is generated in the die cavity during die casting at the time of introduction of the molten aluminum alloy is 50 to 150 mbar.

The cast structure castings are placed onto special contour-embracing product receiving devices and are subjected to the heat treatment steps described above.

The result of these heat treatments is that the distortion of the structure casting is considerably lower than with the heat treatment according to T64 or T7.

Moreover, the service life of the contour-embracing product receiving devices that are used is extended, on account of the thermal stresses during quenching in air being reduced greatly, by a multiple.

Furthermore, it has been established that the Fe content of 0.15 to 0.4% achieves a lasting improvement to the tool service life, which is unsatisfactory with Fe contents of <0.15% in commercially available alloys for the structure casting sector. No adverse effects on the dynamic and static characteristic values were recorded.

With an aluminum alloy of the following composition:

| | |
|---|---|
| Si: | 9.5–11.5% |
| Fe: | 0.15–0.4% |
| Mg: | 0.3–0.4% |
| Cu: | <0.02% |
| Mn: | 0.4–0.6% |
| Ti: | 0.15–0.2% |

Remainder: aluminum and trace elements

| Heat treatment | Rp0.2 in MPa | A5 in % |
|---|---|---|
| 1st stage 490° C. approx 90 min<br>2nd stage 250° C. approx 105 min | 120–130 | 12–15 |
| 1st stage 490° C. approx 90 min<br>2nd stage 250° C. approx 75 min | 130–135 | 11–13 |
| 1st stage 490° C. approx 90 min<br>2nd stage 250° C. approx 45 min | 140–145 | 8–10 |
| 1st stage 490° C. approx 90 min<br>2nd stage 250° C. approx 30 min | 145–150 | 8–10 |
| 1st stage 490° C. approx 90 min<br>2nd stage 250° C. approx 30 min | 145–150 | 8–10 |

wherein Rp0.2 means yield strength at 0.2% permanent elongation; MPa means $10^6$ Pascal and A5% means elongation at break with a sample having a rational length of measurement to diameter of Lo = 5do.

While the process T64 requires a minimum heat treatment time of 4 hours and a maximum treatment time of 11 hours, and the heat treatment process T7 requires a minimum heat treatment time of likewise 4 hours and a maximum heat treatment time of 8 hours, the process according to the invention lasts at most 3.25 hours, but in the most expedient situation can be shortened to as little as 1.5 hours. Therefore, the process according to the invention is generally more economical, on account of the shorter cycle time. Furthermore, the thermal stability is improved, on account of the temperature in the second stage having been increased by approximately 30° C. compared to heat treatment process T7 and by approximately 80° C. compared to heat treatment process T64, so that the structure castings which have been heat-treated using the process according to the invention are thermally stable up to use temperatures of 250° C.

The aluminum alloys according to the invention for use with the process according to the invention make it possible to produce very thin-walled, large-area and complex structure castings, the mold strength and dimensional accuracy of which is ensured by the heat treatment process according to the invention. Accordingly, the process according to the invention and the alloy used with this process provide the designer with considerable design freedom. The process according to the invention and the aluminum alloys used therewith make it possible to ensure uniform quality in mass production, high ductility, good weldability and therefore the possibility of joining to metal sheets or extruded sections.

What is claimed is:

1. A process for the heat treatment of structure castings made from an aluminum alloy, comprising the steps of:

placing the structure casting onto a contour-embracing product receiving device, heating the casting to 490° C. over the course of approximately 30 minutes, holding the temperature of 490° C. for a time of between 60 and 90 minutes, quenching in air from 490° C. to approximately 100° C. over the course of approximately 4 minutes, heating to 250° C. over the course of approximately 15 minutes, holding the temperature of 250° C. for a time of between 30 and 105 minutes, quenching in air 40° C.

2. The process as claimed in claim 1, in which the temperature of 490° C. is held for approximately 60 minutes, and the temperature of 250° C. is held for approximately 30 minutes.

3. The process as claimed in claim 1, in which the temperature of 490° C. is held for approximately 90 minutes, and the temperature of 250° C. is held for approximately 30 minutes.

4. The process as claimed in claim 1, further comprising subjecting the aluminum alloy to a melt treatment before casting.

5. The process as claimed in claim 4, wherein the melt treatment is degassing.

6. The process as claimed in claim 4, wherein the melt treatment is filtration.

7. The process as claimed in claim 1, further comprising after the first quenching in air, quenching in water.

8. The process as claimed in claim 1, further comprising after the second quenching in air, quenching in water.

9. The process as claimed in claim 1, further comprising after each quenching in air, quenching in water.

10. The process as claimed in claim 1, in which the temperature of 490° C. is held for approximately 90 minutes, and the temperature of 250° C. is held for approximately 45 minutes.

11. The process as claimed in claim 1, in which the temperature of 490° C. is held for approximately 90 minutes, and the temperature of 250° C. is held for approximately 60 minutes.

12. The process as claimed in claim 1, in which the temperature of 490° C. is held for approximately 90 minutes, and the temperature of 250° C. is held for approximately 105 minutes.

* * * * *